US005866199A

United States Patent [19]

Swidler et al.

[11] Patent Number: 5,866,199

[45] Date of Patent: Feb. 2, 1999

[54] PRIMER-PAINT MASK COMPOSITION AND METHODS OF USE THEREOF

[75] Inventors: Ronald Swidler, Palo Alto; Edward W. Woodhall, Los Altos, both of Calif.

[73] Assignee: Cal-West Equipment Company, Inc., Sunnyvale, Calif.

[21] Appl. No.: 551,004

[22] Filed: Oct. 31, 1995

[51] Int. Cl.[6] ..... B65D 3/62

[52] U.S. Cl. ..... 427/154; 427/155; 427/156; 427/385.5; 427/393.6; 427/398.7; 427/467.1; 427/467.2

[58] Field of Search ..... 427/154–156, 427/282, 385.5, 393.6, 389.7, 393.5, 407.1, 407.2, 408

[56] References Cited

U.S. PATENT DOCUMENTS 5,143,949 9/1992 Grogan et al. ..... 427/154

5,418,006 5/1995 Roth et al. ..... 427/154

FOREIGN PATENT DOCUMENTS

WO 92/02307 7/1990 WIPO .

*Primary Examiner*—Janyce Bell

*Attorney, Agent, or Firm*—Townsend and Townsend and Crew LLP

[57] ABSTRACT

This invention provides for primer/masking compositions that have differential adhesion properties for glass-like and non-glass surfaces. The compositions are used in a method of applying a finish to a non-glass surface which resides in proximity to a glass-like surface without substantially over-coating the glass-like surface. The method involves applying to the glass-like surface a primer/masking composition comprising a vinyl chloride copolymer emulsion, a coalescer, and a surfactant; applying the finish to the non-glass surface, and removing the primer/masking composition from said glass-like surface.

13 Claims, No Drawings

PRIMER-PAINT MASK COMPOSITION AND METHODS OF USE THEREOF

BACKGROUND OF THE INVENTION

This invention pertains to coatings that protect glass-like surfaces from paint or other coating materials while at the same time acting as a primer or undercoating for non-glass surfaces. The coatings show high adhesion to non-glass surfaces and low adhesion to glass-like surfaces so that they may be removed from the glass-like surfaces while remaining tightly bound to the non-glass surfaces.

It is often desirable to provide a finished (e.g. painted, varnished, shellacked, or otherwise overcoated) surface in proximity to a non-finished surface on a wide variety of articles. Thus, for example, it is frequently desired to paint a window frame and/or the juncture between the window frame and the glass, without painting the glass itself. A similar problem arises in other contexts, including but not limited to painting adjacent to trim or glass on automobiles, painting mirror frames, and so forth.

Such painting or other overcoating is often accomplished by the careful manual application of the overcoat. This method can be difficult, time consuming and require an inordinate painting skill. Other methods include painting at will on the glass surface or window pane while painting the non-glass surface. A scraper or razor blade is then used to remove the paint from the glass-like surface. While ordinary paint can be scraped off within hours after being applied, after that short period it may adhere to the glass surface strongly. In addition, particularly where the underlying "glass" surface is a soft material (e.g., an acrylic plastic) the scraping procedure may often mar the surface.

Yet another method involves masking. With masking, a covering (e.g., newspaper and/or tape) is placed on surface it is desired to protect from the overcoating (e.g., painting) operation. The non-glass surface is painted and the masking material is removed leaving the glass-like surface essentially free of paint or other overcoating. This method, however, requires the time-consuming operation of carefully applying the masking materials so that they line up with and abut the juncture at the edge of the glass-like material.

Finally, another masking approach involves the use of a "paint on" acrylic coating that dries to form a continuous film. The coating adheres weakly to a glass-like surface, but tightly to a non-glass surface. After application of a finish to the masked object, the acrylic coating is removed from the glass-like (masked) area, but not from the non-glass area. This leaves the glass-like area that area essentially free of the finish material (see, e.g. PCT application WO 92/02307).

SUMMARY OF THE INVENTION

This invention provides for compositions that act as both primers and masks. The compositions adhere tightly to a non-glass surface and less tightly to a glass-like surface. In contrast to previously described compositions, the compositions of this invention are relatively simple formulations, show particularly good adhesion to non-glass surfaces and readily release from glass-like surfaces. In addition, the compositions of this invention show unusually good water resistance, are sandable, and are resistant to cleaners such as ammonia or glass cleaners.

In one embodiment this invention provides for a primer/masking composition comprising a vinyl chloride copolymer emulsion (e.g. 1957, B. F. Goodrich, Cleveland, Ohio, USA); a coalescer (e.g., propylene glycol t-butyl ether (PTB)); and a surfactant. The primer/masking composition can additionally include a thickener (e.g., EP 1, EZ-1, etc.) and/or a pigment (e.g., $TiO_2$). Suitable concentrations of these components are as described herein.

In a particularly preferred embodiment, the primer/masking composition includes about 10% to about 99% vinyl chloride copolymer (e.g. 1957), about 2% t about 4%, by weight coalescer (e.g. propylene glycol ether), and a surfactant (e.g., Surfynol® 104PA) in an amount sufficient to permit the composition to wet a glass-like or non-glass surface to which it is applied. The primer/masking composition can further include a thickener (e.g., EP 1) present at about 1% to about 10%, by weight of the total primer/coating composition and/or a pigment (e.g. $TiO_2$) present at up to about 10%, by weight of the total primer/coating composition.

In another embodiment, this invention provides a method of applying a finish to a non-glass surface which resides in proximity to a glass-like surface without substantially overcoating the glass-like surface. The method involves applying any of the primer/masking coatings of this invention to the glass-like surface such that the coating forms a substantially continuous film; applying a finish to the non-glass material; and removing the primer/masking composition from the glass-like surface thereby leaving the glass-like surface substantially free of the finish. The primer/masking composition need only be applied over a sufficient width on the glass-like surface to serve as a mask over the glass-like surface. Thus, the primer/masking composition can be applied as a band adjacent to a non-glass surface. Alternatively, the primer/masking composition can be applied across the entire glass-like surface.

The finish can be allowed to substantially dry before removing the primer/masking coating, or alternatively, the primer/masking coating can be removed while the finish is still wet. The primer/masking coating can be removed by any convenient means, however removal by peeling is preferred. The primer/masking composition can be scored before peeling. Suitable glass-like surfaces include, but are not limited to, glass, acrylic, Formica®, ceramic, enamel, and porcelain, while suitable non-glass surfaces include, but are not limited to, wood, aluminum, latex paints, and alkyd paints. Finishes compatible with the primer/masking material include, but are not limited to, latex paints, alkyd paints, varnishes, shellacks, and the like.

This invention further contemplates the use of the primer/mask coatings themselves as paint or painting compositions. In this embodiment, the application of an overcoating or finish is not required. Thus, this invention also provides for a method for applying a finish to a non-glass surface. The method involves applying a primer/masking coating of this invention to the non-glass surface and drying the composition. If the non-glass surface resides adjacent to or in proximity to a glass-like surface which becomes coated (partially or completely) with the primer/masking composition, the method can also involve removing (e.g. by peeling) the primer/masking composition from the glass-like surface. Suitable glass-like and non-glass surfaces are as described herein.

In yet another embodiment, this invention provides for an article of manufacture comprising a glass-like surface and a non-glass surface wherein said glass-like surface is coated with one of the primer/masking compositions of this invention. Coated articles of manufacture can include, but are not limited to a door, a window, home fixtures such as furniture, cabinets, mirrors, laminated countertops, and the like.

All weight percentages provided herein refer to the dry weight of the active material. Commercial products may contain water addition to the active material. The coatings of this invention are compounded as aqueous solutions. Water may therefore comprise up to about 70 percent by weight of the composition before drying.

A further understanding of the nature and advantages of the invention described herein may be realized by reference to the remaining portions of the specification.

DETAILED DESCRIPTION

This invention provides methods and compositions for painting or otherwise overcoating a non-glass surface that is adjacent to, or in proximity to, a glass, or glass-like, surface without substantially overcoating the glass-like surface. The compositions of this invention include primer/mask compositions that adhere strongly to non-glass surfaces while adhering less strongly to glass or glass-like surfaces. Because of this differential adhesive capability these compositions may be applied to both surfaces and then subsequently removed from the glass or glass-like surface while remaining firmly adhered to the non-glass surfaces. The primer/mask thus can act as a paint mask on the surface from which it is removed and as a primer or undercoat on the surface to which it remains adhered. This is particularly advantageous where the non-glass and the glass or glass-like surface are either juxtaposed or in close proximity where the overcoating (finishing) of the non-glass surface is likely to deposit overcoating materials (e.g., paint) on the glass-like surface.

As used herein, the terms "glass-like" or "glass-like surface" refer to high gloss, low porosity surfaces that are typically not to be coated with paint or other finish (overcoating). Such surfaces include, but are not limited to, glass, acrylic or other plastics, alkyd paints, enamels, porcelain, ceramic, and Formica® and other laminates. Conversely, non-glass surfaces refer to surfaces that are typically higher porosity and are to be coated with the primer/coating compositions of this invention and/or a subsequently applied finish (overcoating). Non-glass surfaces include, but are not limited to, wood, metal (e.g., aluminum), textured plastics, and the like.

Glass-like and non-glass surfaces exist adjacent juxtaposed) to each other, or in proximity to each other, in a wide variety of articles. Thus, for example, windows in window frames, glass in doors, shelves, or cabinets, mirrors in mirror frames, provide a glass surface juxtaposed to a non-glass surface (e.g., the wood surface of the door or window frame, or the wood or metal finish of the mirror frame). The glass-like and non-glass surfaces are said to be in proximity to each other when application of a coating to the non-glass surface risks undesired and/or inadvertent application of that coating to all or part of the glass-like surface. One of skill will appreciate that "proximity" is in part influenced by the means of application of the finish coating. Thus, for example, where the finish coating is sprayed on the non-glass surface, airborne overspray may travel a considerable distance (e.g. a number of feet) to be deposited on the glass-like surface. In contrast, where the finish coating is applied, for example, by brush, only glass-like surfaces essentially juxtaposed to the non-glass surface need be masked by the primer/masking composition.

In one embodiment, this invention provides for a method of applying a finish to a surface. The method generally involves the steps of i) applying a primer/masking coating of this invention to a glass or glass-like surface; ii) applying a finish to a non-glass surface juxtaposed to, or in proximity to, the glass-like surface; and iii) removing the primer/masking composition from the glass-like surface thereby leaving the glass-like surface free of the finish.

The primer/masking coating, when applied to the glass-like surface, acts as a paint mask. The coating may be applied to the surface by any of a number of means well known to those of skill in the art. Such means include, but are not limited to application by brushes, rollers, spraying, dipping, spreading, the use of "doctor" bars, and so forth. In a preferred embodiment, the coating is applied by brushes, rollers or spraying. In other preferred embodiments, the coating composition is applied in an aerosol form to a surface. In such embodiments, the composition is stored in a container pressurized with any of a number of propellants including such environmentally benign materials as dimethyl ether, nitrogen, or carbon dioxide. Alternatively, the composition can be stored in a pump-type spray can.

Whichever means is selected, the coating is applied to form a substantially continuous film over the surface to which it is applied By "substantially continuous film" it is intended to mean herein a film generally lacking pinholes through which water, oil, paint, dust, or other materials could reach the underlying surface.

The primer/masking coating may be applied exclusively to the glass-like surface where it acts simply as a paint mask. However, the primer/mask coating, may be applied to the juxtaposed (adjacent) or proximate non-glass surface as well where, because of its differential adhesive properties, it acts as a permanent primer or undercoating for the subsequently applied finish.

One of skill in the art will appreciate that in many circumstances, it is not necessary to apply the primer/masking coating to the entire glass surface. Thus, for example, where the glass surface is relatively large, it may only be necessary to apply the primer/masking coating along the edges adjacent to or near to the non-glass surface, where a finish coating is most likely to be deposited when the finish is applied.

As indicated above, the primer/mask material need not be applied at all to the non-glass material. However, a principle advantage of the primer/mask compositions of this invention is that they act as a good primer (sealer) or undercoating. Thus, in a preferred embodiment, the primer/mask is also applied to the non-glass surface. The primer/mask composition need not be applied to the entire non-glass surface, however, in a preferred embodiment, it is so applied to provide a uniform undercoating.

The coating, while applied as a liquid, will form a substantially continuous solid sheet when dried. Drying may be accomplished at room temperature (i.e. by air drying). The coating may also be force-dried according to any of a number of methods known to those of skill in the art. Such methods include, but are not limited to the application of heat (e.g. radiant heating, oven baking, or hot air blowers), the reduction of air humidity, air movement or any combination of these means.

After the primer/masking coating is dried, the coated article may be overcoated with a finish, or alternatively, the coated article may be stored for finishing at a later date. Thus, for example, finish-ready articles (e.g. windows) coated with a primer/masking coating of this invention can be prepared at a factory. The final finish can be applied later at the factory, after shipping by a distributor, or by an end user (e.g. home user, contractor, or carpenter) once the final finish coat color and composition is determined.

Like the primer/masking coating, the finish coating can be applied by any of a number of means well known to those of skill in the art. Such means include, but are not limited to application by brushes, rollers, spraying, dipping, spreading, the use of "doctor" bars, and so forth. In a preferred embodiment, the coating is applied by brushes, rollers or spraying.

Once the finish coating has been applied, the primer/masking coating can be selectively removed from the glass surface thereby leaving the glass surface substantially free of the finish coating. In a preferred embodiment, removal of the primer/masking coating involves scoring or cutting the coating (e.g. with a razor blade or other sharp implement) at the edge of the region from which the primer/masking coating is to be removed. The scoring or cutting can be performed before or after application of the finish coating. In a preferred embodiment, the scoring or cutting is performed after application of the finish coating to prevent resealing of the score by the finish coat or bleed through of the finish coat through the score.

In a preferred embodiment, the primer/masking coating is removed from the underlying glass surface simply by lifting up or peeling. Peeling can be by hand or with the aid of a tool. The primer/masking coating may also be removed by scraping (e.g, with a scraper) or through abrasion (e.g., with steel wool or an abrasive pad).

This invention further contemplates the use of the primer/mask coatings itself as a paint or painting composition. In this embodiment, the application of an overcoating or finish is not required. This invention thus provides for a method of finishing a non-glass surface where the method simply involves applying a primer/masking coating of this invention to a non-glass surface. Where the non-glass surface is adjacent to, or in proximity to, a glass-like surface, the method can further involve the step of removing primer/masking composition that is present on the glass, or glass-like, surface thereby leaving the non-glass surface coated with the primer/mask coating and the glass-like surface free of the primer/masking coating.

In a preferred embodiment, the primer/masking compositions of this invention comprise a vinyl chloride copolymer emulsion, a coalescer, and a surfactant. The vinyl chloride copolymer emulsion provides a film former that shows good adhesion to non-glass surfaces and low adhesion to glass, or glass-like, surfaces. In addition, the vinyl chloride copolymer provides sufficient flexibility and mechanical strength to facilitate easy peel-off from a glass-like, surface. Finally, the vinyl chloride copolymer is compatible with a number of finishes including, but not limited to latex paint, alkyd paints, varnishes, shellacks, and the like.

Suitable vinyl chloride copolymer emulsions are commercially available and include, but are not limited to, 1957 (B. F. Goodrich, Cleveland, Ohio, USA). In a preferred embodiment, the vinyl chloride copolymer is present at about 10% to about 99%, preferably about 60% to about 98%, more preferably about 90% to about 98%, and most preferably about 95%, by weight of the primer/masking composition.

Film formation is enhanced by the presence of a coalescer which, without being bound to a particular theory, is believed to enhance the interaction and "stickiness" of the vinyl chloride particles comprising the emulsion thereby improving film continuity and mechanical strength. Suitable coalescers include propylene glycol t-butyl ether (PTB) (e.g., Arcosol), Texanol, butyl cellosolve and the like. The coalescer is preferably present at about 0.5% to about 5%, more preferably about 1% to about 3% and most preferably about 1.5% to about 2.5%, by weight of the primer/masking composition.

The primer/masking compositions preferably include a surfactant to provide surface wetting and leveling of the coating composition. Preferred surfactants include non-ionic and anionic surfactants. Particularly preferred surfactants include acetylenic diol alcohols (e.g. Surfynol® 104PA, Air Products). Other suitable surfactants include, but are not limited to, sodium dodecyl sulfate (SDS) and Neodol 19-6. The surfactant is present in an amount sufficient to level said primer/masking composition or to allow the primer/masking composition to wet the underlying surface. Thus, in a preferred embodiment, surfactant concentrations range from about 0.1% to about 10%, preferably from about 0.5% to about 5%, more preferably from about 0.5% to about 3% and most preferably from about 1% to about 2%, by weight, of the primer/masking composition.

In order to facilitate application (e.g., prevent dripping and running), the primer/masking composition can additionally include a thickener. The thickener may be utilized to regulate the viscosity and film thickness of the protective coating composition. Preferred thickeners show little or no water sensitivity. Thus silicone based thickeners are particularly suitable for this invention. Acrylic thickeners selected for low water sensitivity and capable of imparting shear-thinning characteristics (e.g., Carbopol 1342, EP1, EZ-1 [B. F. Goodrich], and montmorillonite) are particularly preferred for use in this invention. The thickener may be present at about 0.1% to about 5%, more preferably at about 0.5% to about 3%, and most preferably about 1% to about 2%, by weight, of the total composition.

In a particularly preferred embodiment, the primer/masking composition includes the vinyl chloride copolymer (e.g., B. F. Goodrich 1957) at about 10% to 90%, by weight of the composition, the coalescer (e.g., propylene glycol t-butyl ether (PTB)) at up to about 4%, by weight, of said primer/masking composition; and a surfactant, in particular an acetylenic diol alcohol surfactant (e.g., Surfynol® 104 PA) in an amount sufficient to allow the primer/masking composition to wet the surfaces to which it is applied.

As indicated above, the primer/masking composition can additionally include a thickener. When present, the thickener (e.g., EP 1) comprises up to about 10%, by weight of the primer/masking composition.

In addition to the above-described components, the primer/masking composition may include a variety of other materials such as cosolvents, antioxidants, antiozonates, UV stabilizers, colorants, defoamers, corrosion inhibitors etc. In particular, as the above-described components typically produce a clear film, pigments may be added where a colored film is desired.

The pigment is a finely divided material which contributes to optical and other properties of the coating. The pigment is insoluble in the coating medium (e.g. the aqueous dispersion) and is typically mechanically mixed with the coating and deposited when the coating dries. The physical properties of the pigment are not changed by incorporation in and deposition from the coating.

Preferred pigments are inorganic "white" pigments although colored and certain organic pigments are also suitable. Inorganic white pigments suitable for this invention include, but are not limited to, titanium dioxide, white lead, zinc oxide, lithopone (a mixture of zinc sulfide and barium sulfate), zinc sulfide, calcium carbonate, mica, silica, and antimony oxide, with titanium dioxide being most preferred.

In a preferred embodiment a pigment can be present in an amount ranging from about 1% to about 10%, more preferably from about 2% to about 7%, and most preferably from about 3% to about 5%, by weight of the total primer/masking composition.

Thus, in another embodiment, the primer/masking composition can comprise a vinyl chloride copolymer (e.g., B. F. Goodrich 1957), a coalescer (e.g., polyethylene glycol t-butyl ether), a thickener (e.g., EP 1), a surfactant (e.g., Surfynol® 104PA), and a pigment (e.g. $TiO_2$) as described above.

As indicated above, the primer/masking coating can be applied to a surface (e.g., a window frame) dried and left on that surface indefinitely leaving the coated object ready for subsequent finishing steps at a later date (e.g., by a distributor, home user, builder, etc.). Thus, in another embodiment, this invention provides for articles of manufacture coated with any of the above-described primer/masking compositions. In a preferred embodiment, the article of manufacture comprises a glass-like surface and a non-glass surface. The primer/masking composition can be applied to either the glass-like surface the non-glass surface or bother surfaces. IN addition, the primer/masking composition may partially cover or entirely cover either or both surfaces. Particularly preferred coated articles of manufacture include, but are not limited to, windows, doors, furniture, cabinets, mirrors, laminated countertops, and the like.

The coatings of this invention are designed to be easily compounded out of readily available precursors. Thus another advantage of the present invention is the relatively simple formulation and therefore low labor costs in producing the coatings. The coating compositions of the invention are made by conventional means, typically including steps of simply admixing the components (or aqueous solutions, dispersions, etc. thereof) at substantially atmospheric pressure so as to form a substantially homogeneous mixture. Care should be taken when mixing the polymer emulsions to produce a clear film (i.e., the polymers should be miscible) so that the coating's mechanical properties are uniform.

When used for the first time with a previously untested glass-like surface, non-glass surface or finish that is to be subsequently applied, it is recommended that the primer/masking composition be tested for acceptable peelability from the glass-like surface, acceptable adherence to the non-glass surface and compatibility with the finish. Such tests are well known to those of skill in the art. Briefly, such a test involves applying the primer/masking composition to the glass-like surface and/or the non-glass surface in question. The composition is allowed to dry and then peeling tests are performed on the surface in question. Typically peeling tests involve laying tape down on the test surface, being sure to leave a portion of the test surface exposed. The tape and test surface are both coated with the primer/masking composition which is then allowed to dry for 24 hours. The coating is then lifted off by lifting up the underlying tape and the ease of removal of the primer/masking coating is evaluated.

Compatibility of the primer/masking composition with a particular finish can be determined according to standard methods known to those of skill in the art. Briefly, the primer/masking coating is applied to a test surface and allowed to dry for 24 hours. Tape is then attached to the coated surface and the finish coat that is to be tested is applied to the primer/masking composition and to one half of the tape leaving a portion of the tape uncoated. The finish coat is allowed to dry and/or cure. The tape is then peeled up and the adhesion of the finish coating is evaluated.

The compositions of the present invention can be exploited by makers of coating compositions, masking products, paints, primers and the like. The methods of the present invention can be exploited by manufacturers and distributors of building materials, painting contractors, homeowners, motor vehicle manufacturers, hobbyists, or anyone needing to paint non-glass materials adjacent to or in the proximity of glass-like surfaces rapidly and inexpensively.

EXAMPLES

The following examples are offered to illustrate, but not to limit the present invention.

Example 1

The following components were combined at room temperature and at atmospheric pressure by slow stirring to form a suitable surface protective coating composition of the invention.

TABLE 1

Two formulations of a primer/masking composition.

| Ingredient | Description | White Formulation (%) | Clear Formulation (%) |
|---|---|---|---|
| B. F. Goodrich 1957 | vinyl chloride copolymer emulsion | 91.75 | 95.75 |
| PTB | Propylene Glycol t-butyl Ether (coalescer) | 2.00 | 2.00 |
| Titanium dioxide | pigment | 4.00 | 4.00 |
| Surfactant | acetylenic diol alcohol | 1.25 | 0.00 |
| EP 1 Thickener | acrylic polymer emulsion | 1.00 | 1.00 |

The primer/masking composition was applied by spraying to a window in a wooden frame. The composition was applied in an even film over both the glass windowpane and the adjacent frame to form a coating approximately 3 to 5 mils thick, when dry. After drying, the composition was readily scored and manually peeled up off of the glass surface. In contrast, the primer/masking coating was to be effectively removed from the wooden surface using manual means. Similar results were observed with glass windowpanes in aluminum frames.

It is understood that the examples and embodiments described herein are for illustrative purposes only and that various modifications or changes in light thereof will be suggested to persons skilled in the art and are to be included within the spirit and purview of this application and scope of the appended claims. All publications, patents, and patent applications cited herein are hereby incorporated by reference for all purposes.

What is claimed is:

1. A method for applying a finish to a non-glass surface which resides in proximity to a glass-like surface without substantially overcoating said glass-like surface, said method comprising:

i) applying to said glass-like and said non-glass surfaces an aqueous primer/masking composition such that said primer/masking composition forms a substantially continuous film, wherein said primer masking composition comprises:
a vinyl chloride copolymer,
a coalescer; and
a surfactant; and ii) applying said finish to said non-glass surface; and iii) removing said primer/masking composition from said glass-like surface while leaving said primer/masking composition on said non-glass surface whereby said primer/masking composition forms a permanent primer for said finish;

wherein said glass-like surface is selected from the group consisting of glass, acrylic, Formica®, ceramic, enamel, and porcelain.

2. The method of claim 1, wherein said applying of step i) comprises applying said primer/masking composition over a sufficient width on said glass-like surface to serve as a mask over said glass-like surface.

3. The method of claim 1, wherein said applying of step i) applies said primer/masking composition to at least a portion of said non-glass surface.

4. The method of claim 1, further comprising allowing said finish to substantially dry before said removing step iii).

5. The method of claim 1, wherein said removing comprises peeling said primer/masking composition away from said glass-like surface.

6. The method of claim 1, wherein said glass-like surface is glass in a window or door.

7. The method of claim 1, wherein said non-glass surface is selected from the group consisting of wood, aluminum, latex paints, and alkyd.

8. The method of claim 1, wherein said finish is selected from the group consisting of a latex paint, an alkyd paint, a varnish, and a shellack.

9. The method of claim 1, wherein said primer/masking composition further comprises a thickener.

10. The method of claim 9, wherein said primer/masking composition further comprises a pigment.

11. The method of claim 1, wherein said vinyl chloride copolymer is present at about 10% to about 90%, by weight, of said primer/masking composition;

said coalescer is present at about 0.1% to about 4%, by weight, of said primer/masking composition; and said surfactant is present in an amount sufficient to allow said primer/masking composition to wet said glass-like and said non-glass surfaces.

12. The method of claim 11, wherein said primer/masking composition further comprises a thickener present at about 0.1% to about 10%, by weight of said primer/masking composition.

13. The method of claim 12 wherein said primer/masking composition further comprises a pigment ranging from about 1% to about 10%, by weight of said primer/masking composition.

* * * * *